US005548277A

United States Patent [19]

Wild

[11] Patent Number: 5,548,277

[45] Date of Patent: Aug. 20, 1996

[54] FLAME SENSOR MODULE

[75] Inventor: Gary G. Wild, Rockford, Ill.

[73] Assignee: Eclipse, Inc., Rockford, Ill.

[21] Appl. No.: 203,170

[22] Filed: Feb. 28, 1994

[51] Int. Cl.[6] ..... G08B 17/12

[52] U.S. Cl. ..... 340/578; 250/372; 250/554; 340/511; 340/579; 340/693; 431/78

[58] Field of Search ..... 340/578, 579, 340/693, 511, 521, 522; 250/554, 372; 431/78–79

[56] References Cited

U.S. PATENT DOCUMENTS

| | | | |
|---|---|---|---|
| 3,266,026 | 8/1966 | Plambeck | 340/579 X |
| 3,437,884 | 4/1969 | Mandock et al. | 340/579 X |
| 3,500,469 | 3/1970 | Plambeck et al. | 340/520 |
| 3,576,556 | 4/1971 | Sellors | 340/579 |
| 3,817,687 | 6/1974 | Cavallero et al. | 431/202 |
| 3,905,126 | 9/1975 | Villalobos et al. | 34/72 |
| 4,000,961 | 1/1977 | Mandock | 431/78 X |
| 5,365,223 | 11/1994 | Sigafus | 340/578 X |

FOREIGN PATENT DOCUMENTS 1276672 6/1972 United Kingdom .

OTHER PUBLICATIONS

"Single and Multi–Burner Solid State Protectofier Combustion Safeguard", Bulletin P–24–R, Form 6642V, of Protection Controls, Inc. in Skokie, Illinois, date unknown.

"Sens–A–Flame II Single–& Multi–Burner Combustion Safeguard", brochure of Pyronics, Inc. in Cleveland, Ohio, date unknown.

*Primary Examiner*—Thomas Mullen
*Attorney, Agent, or Firm*—Leydig, Voit & Mayer, Ltd.

[57] ABSTRACT

A standalone modular flame sensor containing a multifunction power supply having outputs for both a flame rod and an ultraviolet transducer. The module also contains interfaces for the ultraviolet transducer and for the flame rod transducer. The interfaces are brought together at a summing junction arranged so that the module will work with either a flame rod, an ultraviolet transducer, or both such transducers. Output circuitry provides not only a flame-on/flame-off indication (both visible via an LED and a switch contact closure), but also provides a continuously variable signal indicating the quality of the sensed flame. The module can be used standalone with either transducer type or incorporated in a more complex control system.

12 Claims, 4 Drawing Sheets

FLAME SENSOR MODULE

FIELD OF THE INVENTION

This invention relates to flame sensors for industrial equipment such as industrial furnaces.

BACKGROUND OF THE INVENTION

There are numerous industrial processes which utilize gas-fired equipment such as furnaces, ovens and driers. Many of them employ multiple stage units requiring multiple burners. Oftentimes they must be fired in a particular sequence. In almost all cases, they must be shut down for a flame failure malfunction in order to avoid the possibility of unwanted combustion or explosion. Associated control systems can be complex or simple, but in all cases they require, as an important input element, sensor circuitry and apparatus for sensing the presence of the flame itself.

Usually, the flame sensor is configured to sense the presence of a pilot flame, to allow the normal sequencing of the equipment when all pilots are sensed as present, and to shut the system down upon failure of any pilot flame. Two types of flame sensing transducers have been developed over the years, and systems are often configured to work with one or the other of such sensors. Each has its respective advantages and disadvantages; in some cases the choice of the type of flame sensor transducer dictates the use of a particular flame sensing interface circuit compatible with it, and thus has broader implications.

One type of flame sensor transducer which has been developed is the flame rod. For present purposes, it is necessary to understand only that the flame rod is a transducer which changes electrical characteristics in the presence of a flame. The transducer is positioned such that it will be in the path of a pilot flame when present. With no flame present, a relatively high alternating voltage coupled to the flame rod will be passed through as an alternating voltage. With flame present, the flame rod will begin to act as a rectifier, with peaks of one polarity getting larger and peaks of the other polarity becoming smaller.

The other type of commonly used transducer is the ultraviolet sensor. It typically operates on a relatively high voltage DC supply, and has an ultraviolet receptor aimed at the pilot flame. The flickering of the pilot flame will cause the output of the ultraviolet sensor to vary, producing an electrical signal which has a ripple component caused by the flicker of the pilot flame. It follows that with no pilot present there will be no ripple and thus a constant DC output.

It will be appreciated that these two types of sensors require separate types of power supplies and separate kinds of interfacing electronic circuitry in order to take advantage of the characteristics of each transducer type. In addition, most flame sensors, at least of the standalone type, provide only a failure indication, in other words, they are bi-state devices, providing one type of signal in the presence of a flame, and another type of signal after a flame failure is detected. Very often, a set of relay driven switch contacts, sometimes driven by an SCR, serve as an output device, with a transition from one state to the other signaling a transition from flame-on to flame failure.

Control systems of reasonable sophistication have been developed to operate large complex furnace or oven systems, and they usually provide forms of sequencing and safety control. Such systems typically require flame sensors as input devices, and can utilize the switch closure feature of typical flame sensors to perform that portion of their function.

Flame sensors can also sometimes be used in standalone fashion, without the need for comprehensive control systems. Prior art flame sensors can be adapted to this use but introduce complexities, such as the need for a complementary power supply, multiple modules for multiple flames, and different kinds of modules for ultraviolet or flame rod operation. It is not unusual for a standalone flame sensor to be just that—a standalone flame sensor. Suppliers of complex systems and standalone flame sensors often utilize different flame sensors for the complex control system. The prior art has attempted to utilize certain standardized modules for multiple purposes. For example, it appears that efforts have been made to utilize a flame sensor module compatible with both flame rods and ultraviolet transducers. However, it is understood that such a device provides only a flame/no-flame indication, and does not provide any additional information on the quality of the sensed flame.

SUMMARY OF THE INVENTION

In view of the foregoing, it is a general aim of the present invention to provide a multi-purpose flame sensor, capable of operating with flame rods and ultraviolet sensors (without modification), capable of operating standalone or in complex control systems, and which additionally provides a signal indicating the quality of the flame.

In a more detailed aspect of the invention, it is an object to provide such a flame quality signal accessible either manually in a standalone mode or by a control system in an integrated mode.

In that respect, it is an object of the present invention to provide a flame sensor having power supply circuitry adapted for both types of flame transducers, interface circuitry which scales signals from the transducers to allow the production of a continuously variable flame quality signal indicating the quality of the flame, and which is equally suitable for either type of flame transducer.

It is an additional object to provide a flame sensor which is small and reliable, and adaptable to two types of flame sensor transducers, and which can be used standalone or integrated into a control system if desired.

In that respect, it is an object of the invention to provide a flame sensor which is sufficiently economical that multiple units can be used in a complex control system, and sufficiently functional that it can operate as a standalone device.

Other objects and advantages will become apparent from the following detailed description when taken in conjunction with the drawings, in which:

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
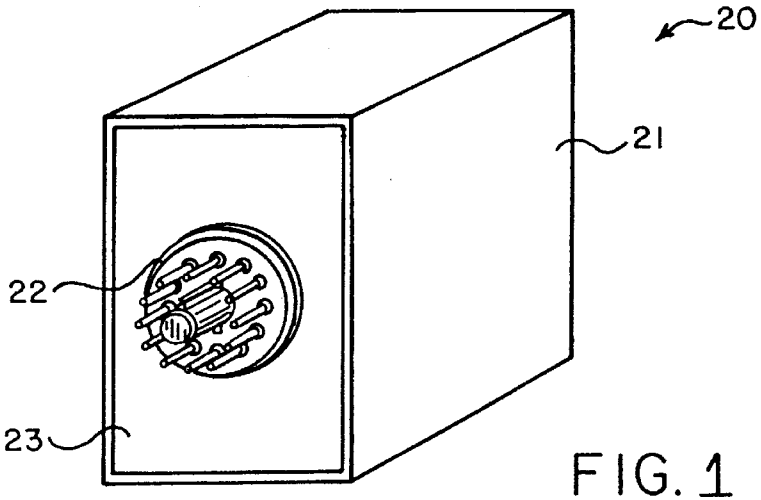
FIG. 1 is a diagram showing the outer appearance of a flame sensor constructed in accordance with the present invention.

Turning now to the drawings, FIG. 1 shows the external configuration of a standalone flame sensor module constructed in accordance with the present invention. The module 20 is packaged much like an industrial relay and includes a generally rectangular enclosure 21 having a standard eleven pin relay plug 22 affixed to a mounting surface 23 thereof. In a commercial embodiment, the enclosure 21 is cubical in shape extending approximately 4" in height and 3" in width, and about 2" in depth.

Figure 3:
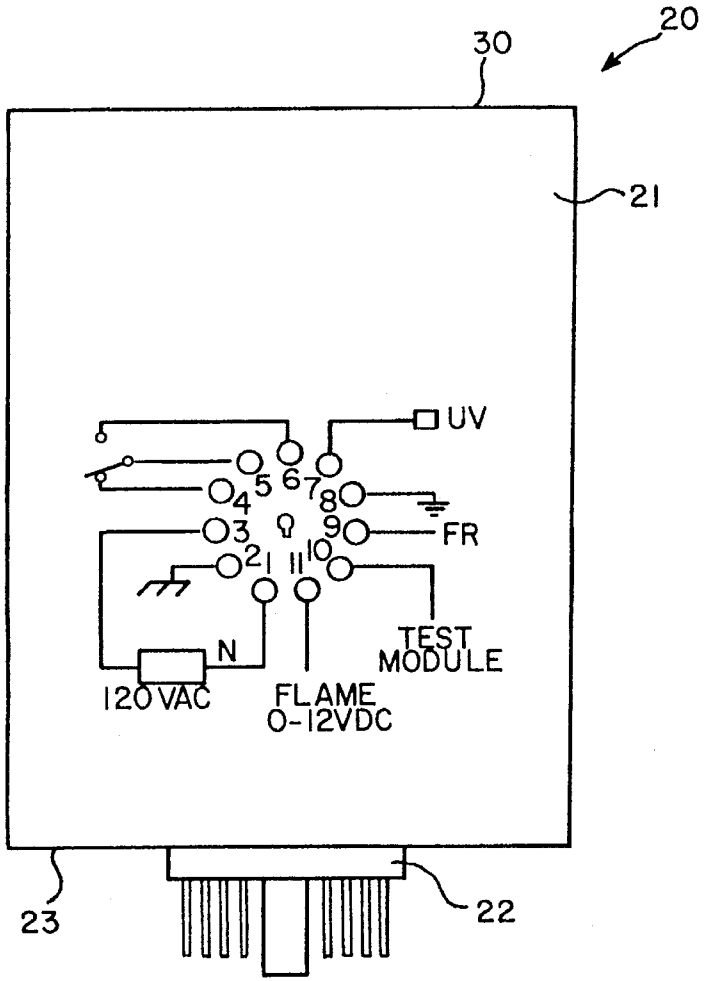
FIG. 3 is a side view of the sensor module of FIGS. 1 and 2 including a diagram of the functional connections of the module.

The eleven pin plug 22 is adapted to fit any conventional eleven pin receptacle which is wired to receive the flame sensing module. For convenience there is reproduced on one of the faces of the module a schematic illustration of the plug and its connections. Such a diagram is shown in FIG. 3. It is seen that pins 1, 2 and 3 of the plug are provided for connection to a standard 120 volt source with earth ground. Pins 4, 5 and 6 are provided for the switched connections operated by the internal relay of the module. It will be seen that pin 5 is connected to the common terminal of the contact set, pin 4 to the normally closed contact and pin 6 to the normally open contact.

Pins 7 through 9 are provided for connection to the flame sensor transducer. Typically, only one type of transducer will be used with the module, but both types can also be used simultaneously. If it is an ultraviolet transducer, it is connected between pins 7 and 8. If it is a flame rod transducer, it is connected to pin 9, with the case of the flame rod being grounded where installed. The flexibility of the module in accepting either type of transducer will be apparent when one considers the possibility of using multiple flame sensors in the same relay rack. In the event a single sensor module fails, the modules can be swapped between sockets (even though some modules are connected to ultraviolet transducers and others are connected to flame rod transducers) without concern for the type of transducer being serviced, because plugging the module into a particular socket makes connections to the correct internal interface.

Pin 10 of the plug provides a connection for a test signal for the module. As will become more apparent, when a voltage is imposed on pin 10, relay test circuitry is energized to determine if the module is operative. Among the features tested are the indicators, the relay and drivers, and whether or not the contacts of the relay have become welded.

Finally, pin 11 of the plug provides for a DC output from the module. According to one aspect of the invention, the flame sensor is capable not only of sensing the presence of a flame, switching the contacts and providing a flame-on or flame-fail indication, but also of providing an analog or continuously variable signal having a magnitude related to the quality of the flame. As a result, a technician without attempting to inspect a complex furnace line in operation can determine simply from reading the voltages on the respective test modules in a cabinet, whether the flame level produced by any of the pilots is sufficiently low to warrant a closer physical inspection. It is noteworthy that such a facility is provided even in the relatively simple and inexpensive standalone form where no complex control system or sequencing circuitry is utilized, simply flame rods or ultraviolet scanners associated with a flame sensor 20 of the invention.

Figure 2:
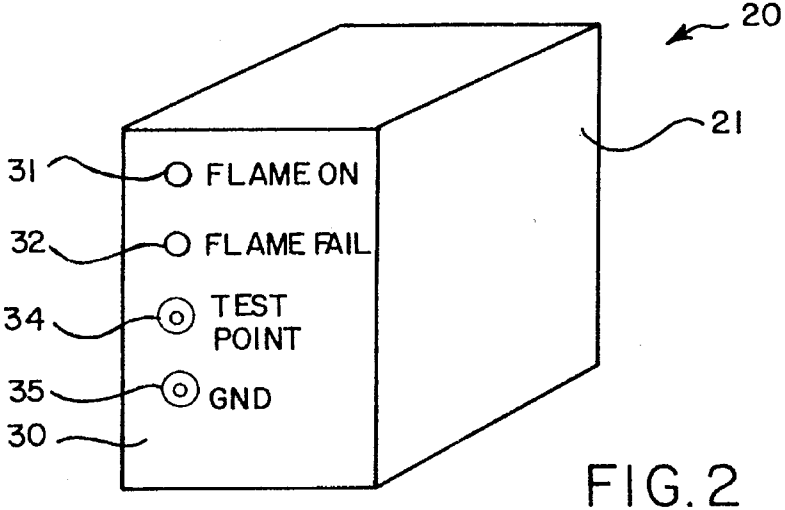
FIG. 2 is a view of the opposite end of the sensor of FIG. 1, showing the indicator and test panel.

FIG. 2 shows the top surface 30 (FIG. 1) of the module and illustrates the "operator interface" of the flame sensor module. It is seen that the module includes a pair of indicators and one pair of test points. A first indicator 31 labeled "flame-on" indicates that the system is functional and that the pilot flame being sensed by the module in question is burning. A second indicator 32 labeled "flame-fail" indicates that the module is functional but that the associated pilot flame has failed. A pair of test points 34, 35 are provided for remotely sensing the quality of the pilot flame. A voltmeter connected across test points 34 and 35 will measure a DC voltage whose level is a measure of the quality of the flame. Typically, in a preferred embodiment, the test point voltage varies to about 12 volts, with levels over about 5 volts being considered adequate for most installations. Operators familiar with a particular installation may understand particular idiosyncrasies of that equipment, and may associate different acceptable test point voltages with the flames in different furnace positions.

Figure 4:
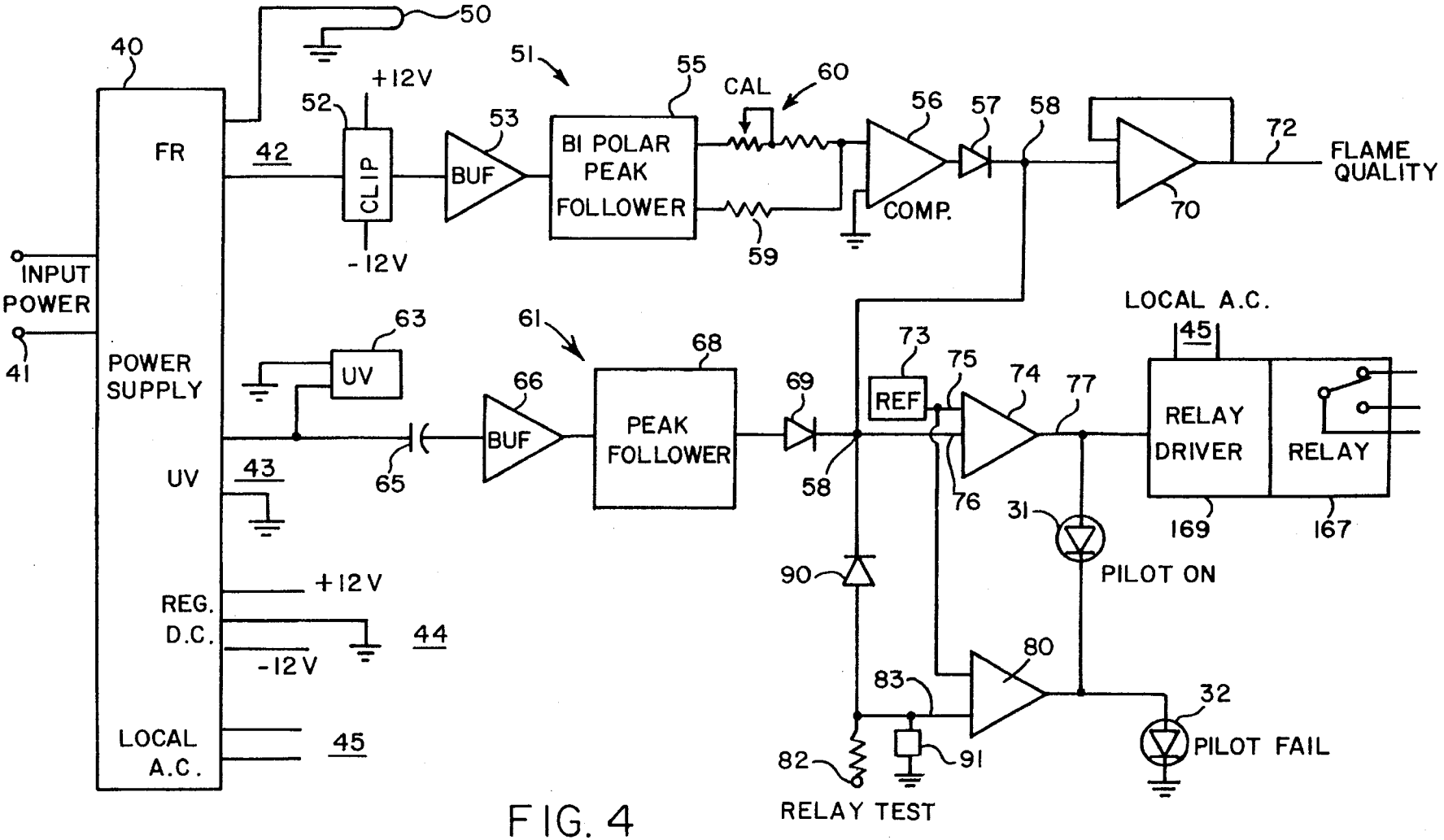
FIG. 4 is a high level functional schematic diagram illustrating the circuitry of a flame sensor module constructed in accordance with the present invention.

Turning then to FIG. 4, there is shown a high level schematic diagram illustrating the circuitry of a flame sensor according to the invention. A multi-function power supply 40 is provided having provision for connection to an AC input supply 41, labeled "input power" in the drawings. In the embodiment of FIGS. 1 and 2, the input power would be the AC source connected to pins 1–3 of the relay socket. In practicing the invention, the power supply 40, although sufficiently miniaturized in size to fit in the relay enclosure of FIG. 1, provides multiple supplies, including a relatively high voltage AC supply 42 for the flame rod, a relatively high voltage DC supply 43 for the ultraviolet transducer, a relatively low voltage regulated DC supply 44 for the electronic elements, and a local AC supply 45. The regulated DC supply in the illustrated embodiment is a bipolar supply providing regulated outputs of +12 and −12 volts for operational amplifiers and the like utilized in the interface and sensing circuitry. The local AC supply 45 is utilized to drive the relay which switches the output contacts.

A flame rod 50 is shown schematically as being connected between the flame rod power supply 42 and ground. The flame rod power supply 42 produces a relatively high voltage AC signal. It is preferred, for example, to use an AC signal on the order of 200 to 400 volts. If a pair of secondaries in a 1:1 isolation transformer are coupled in series, an AC signal of about 350 volt peak will be produced for the power supply 42.

The flame rod 50 has the characteristic that in the absence of a flame it is substantially an open circuit, and the AC signal applied to it is substantially unaffected. In the presence of a flame, however, the flame rod 50 begins to act as a rectifier, and the positive peaks of the AC signal will decrease in magnitude, whereas the negative peaks will increase in magnitude.

In practicing the invention, flame rod interface circuitry 51 processes the flame rod signal to produce an internal signal having a magnitude of particular characteristics to be described in greater detail below. The AC signal produced by the power supply 42 is passed through a clipper 52 which limits peak excursions to positive or negative 12 volts, and thence through a buffer amplifier 53 associated with a bipolar peak follower 55. The bipolar peak follower, as will be described in greater detail below, includes a pair of capacitors, one being charged to the peak positive voltage, and the other to the peak negative voltage. The time constants are such that the charge on the capacitors will change as the magnitudes of the peaks change, but the signal level will integrate from peak to peak to be relatively constant over that short interval. In effect, the circuit arrangement described thus far provides signals having levels which relate to the magnitude of the positive and the magnitude of the negative peak. Those signals are compared in a comparator 56. In the absence of a flame, the comparator 56 senses slightly more positive than negative magnitudes for the positive and negative peaks, and produces an output near ground. As the flame intensity increases, the signal relating to the positive peak gets smaller, whereas the signal related to the negative peak gets larger, causing the output of the comparator 56 to produce an increasingly positive output. That output is passed through a diode 57 to a summing junction 58. It will be noted that the circuitry coupling the bipolar peak follower 55 to the comparator 56 includes scaling resistor 59, and calibrating control 60 calibrating control 60 is adjustable to achieve a DC level at the junction 58 which is calibrated to the magnitude of the flame. That level is adjusted to produce a DC signal at the junction 58 which is calibrated in magnitude to flame quality and of the same magnitude as the positive signal produced by the ultraviolet interface circuits for a comparable flame.

The ultraviolet transducer is illustrated diagrammatically at 63, and is shown connected between ground and one terminal of the ultraviolet power supply 43. The ultraviolet power supply is preferably a relatively high voltage DC supply, desirably on the order of about 425 volts DC. In order to achieve a power supply of that magnitude in the confined space of the module of FIG. 1, a voltage tripler is employed and is driven from the same transformer which powers the other supplies. The ultraviolet transducer 63 is aimed at the flame, and the flicker of the flame causes a ripple in the signal imposed on the DC supply by the ultraviolet transducer.

Ultraviolet transducer interface circuitry 61 processes the signal to produce an internal signal similar to the signal produced by the flame rod interface circuitry 51. The varying signal resulting from the flickering flame is passed through a capacitor 65 serving as an AC coupling means to a buffer amplifier 66 associated with a peak follower 68. The peak follower tracks the maximum excursion in one direction (for example, the positive excursions) of the varying signal AC coupled through the buffer amplifier. A relatively higher level signal stored in the peak follower 68 is an indication of a relatively high level of flicker of the pilot flame, and thus of a relatively good quality flame. The DC signal which is stored in the peak follower 68 is passed through a diode 69 to the summing junction 58. As noted above, the systems are calibrated, such as by means of calibrating control 60, to cause the production of a voltage at node 58 having a magnitude which is calibrated to a known good flame, such that the voltage at point 58 is representative of the quality of the flame no matter whether a flame rod or ultraviolet transducer is utilized.

It will be appreciated that most typically either the flame rod or ultraviolet transducer is utilized for any given position, and not both. It is also useful, and is a feature provided by the invention, that both types of sensors be used with a single module for some cases. For example, for a given furnace the flame rod can be positioned to monitor the pilot, and the ultraviolet transducer aimed at the main burner. The adaptability of the unit is such that the same relay module can be used in any position in a multi-position rack, irrespective of whether any given position serves a flame rod or an ultraviolet transducer or both.

It is noteworthy that the diodes 57, 69, and their coupling to the subsequent comparators (to be described below) causes the junction 58 to serve as a summing junction. In effect, the respective interface means 51, 61 produce positive signals connected through appropriate poled diodes to the summing junction 58. The interface circuitry is constructed such that the absence of the associated flame sensing transducer produces a signal equivalent to a "no flame" signal. Thus, when the module is used in a typical system, there will be one active interface and one inactive interface coupled to the summing junction. The active or inactive interfaces are selected only by virtue of the fact that they have a transducer coupled to them. The voltage level at the summing junction causes the remainder of the circuitry to operate identically irrespective of the type of transducer, or the identity of the active interface. In the case where both types of transducers are connected to the same module, the summing junction will indicate the flame quality resulting from one or both transducers.

The voltage produced at the junction 58 by the interface circuitry described thus far is utilized both to control the bi-state status indication of the module and also to produce the aforementioned analog signal having a magnitude representative of the quality of the flame.

An amplifier 70 has an input coupled to the node 58, and is connected as a unity gain amplifier, to produce an output signal at a junction 72 which is an analog signal representative of flame quality. As noted above, that level is typically about 5 volts at the threshold of a good flame, correspondingly higher for flames of increasing quality, and lower for flames of questionable or inferior quality.

The voltage at junction 58 is also coupled to a comparator 74 having a first input 75 coupled to a reference voltage source 73, and a second input 76 coupled to the junction 58. The reference voltage 73 is set to establish a desired threshold, for example, at 1.6 volts, or 2 volts such that whenever the voltage at junction 58 is higher than that threshold, the output 77 of the comparator 74 will be at a high level. Whenever the voltage is below the threshold, the output 77 will be near ground. When the output 77 is high, the output activates a relay driver 169 which in turn energizes the output relay 167. The relay driver 169 is connected to the local AC supply 45 to utilize the local AC power for operation of the relay. The signal provided by the output 77 serves as a triggering voltage, typically for a triac in the relay driver 169, which serves to maintain the relay energized whenever the interface circuitry 51, 61 determines that a flame is sensed at a level above the threshold. Thus, the relay 167 in the flame-on condition will have the relay contacts switched to the state opposite that shown in FIG. 4, with the normally open contacts closed and the normally closed contacts open.

With the interface circuitry 51, 61 sensing a good flame, the pilot on indicator 31 will also be energized. The high level produced at the output 77 of the comparator 74, coupled with a low output signal produced by a comparator 80 will forward bias a green pilot-on light-emitting diode 31. The green pilot-on LED 31 will glow, thereby indicating that the associated system is functional. If the flame extinguishes, the voltage at the summing junction 58 falls below the reference level, and the module responds by de-energizing LED 31 and dropping out relay 167, returning the relay contacts to the state illustrated in the drawings. In the case where a module has two transducers (e.g., a flame rod and an ultraviolet transducer) connected simultaneously, the comparator 74 will maintain the high output (flame-on LED lit) until both transducers detect the no-flame condition.

The comparator 80 compares the same reference voltage 73, with a DC level coupled from a relay test input P-10 through a diode 82 (see FIG. 6) connected to input 83 of the comparator. Typically, the test input P-10 is held near ground, such that the reference voltage 73 will be higher than the voltage on input 83, causing the output of the comparator 80 to be low. That provides a ground return for current flow through the pilot-on LED 31 so that the LED 31 will be illuminated whenever the comparator 74 detects a flame signal above its threshold.

When it is desired to test the functionality of the system, a test signal is imposed on pin 10 of the input plug. The signal can be AC or DC, and at any level in the range from 12 to 120 volts. That test signal is coupled through a forward-biased diode 90 to the junction 58. A clamp 91 clamps excursions of the signal at the anode of the diode 90 to about 5 volts. Thus, a signal of about 5 volts in magnitude is coupled to the node 58. Considering that the same reference voltage 73 is applied to the reference inputs of both comparators 74 and 80, and considering that the diode drop provided by forward biased diode 90 renders the signal applied to the sensing input of comparator 80 higher than the signal applied to the sensing input of comparator 74, the pilot-on LED 31 will be reverse biased. The fact that the output of comparator 80 has swung positively will also forward-bias the red pilot-fail LED 32, causing it to illuminate. Realizing that the test signal will usually be applied when the furnace is off, prior to application of the test signal the relay 167 will be de-energized by virtue of the lack of a positive signal at the junction 58. Upon application of the test voltage, the rise in voltage at the junction 58 will also activate the relay, allowing a supervisory system (if present) to monitor the relay contacts for proper functionality. This aspect of the test is useful in finding relays that have failed for welded contacts.

Before turning to the detailed circuitry which implements the schematic of FIG. 4, it will be mentioned in summary that the system whose circuitry is illustrated in FIG. 4 is sufficiently miniaturized to fit into a relatively small relay module such as that illustrated in FIGS. 1 and 2. A miniaturized power supply has a single source of input power and has multiple outputs, including a relatively high voltage AC for a flame rod, a relatively high voltage DC for an ultraviolet transducer, low level regulated DC for electronic components and, if necessary, local AC. Separate interface circuitry is provided for coupling to both a flame rod and to an ultraviolet transducer. The interface circuitry is arranged to produce outputs from the respective types of sensors such that the level of the output signal produced is a measure of the flame quality sensed by the transducer, irrespective of the type of transducer utilized. The interface circuitry outputs are added at a summing junction which drives a flame quality sensing circuit producing an analog output having a continuously variable level whose magnitude is indicative of the quality of the flame. The signal is also brought to comparator which compares the signal with a reference level to distinguish between a flame-on and flame-fail condition. Appropriate indicators are provided, and a test signal utilized to cycle the equipment irrespective of the condition of the pilot to determine its functionality.

Figure 5:
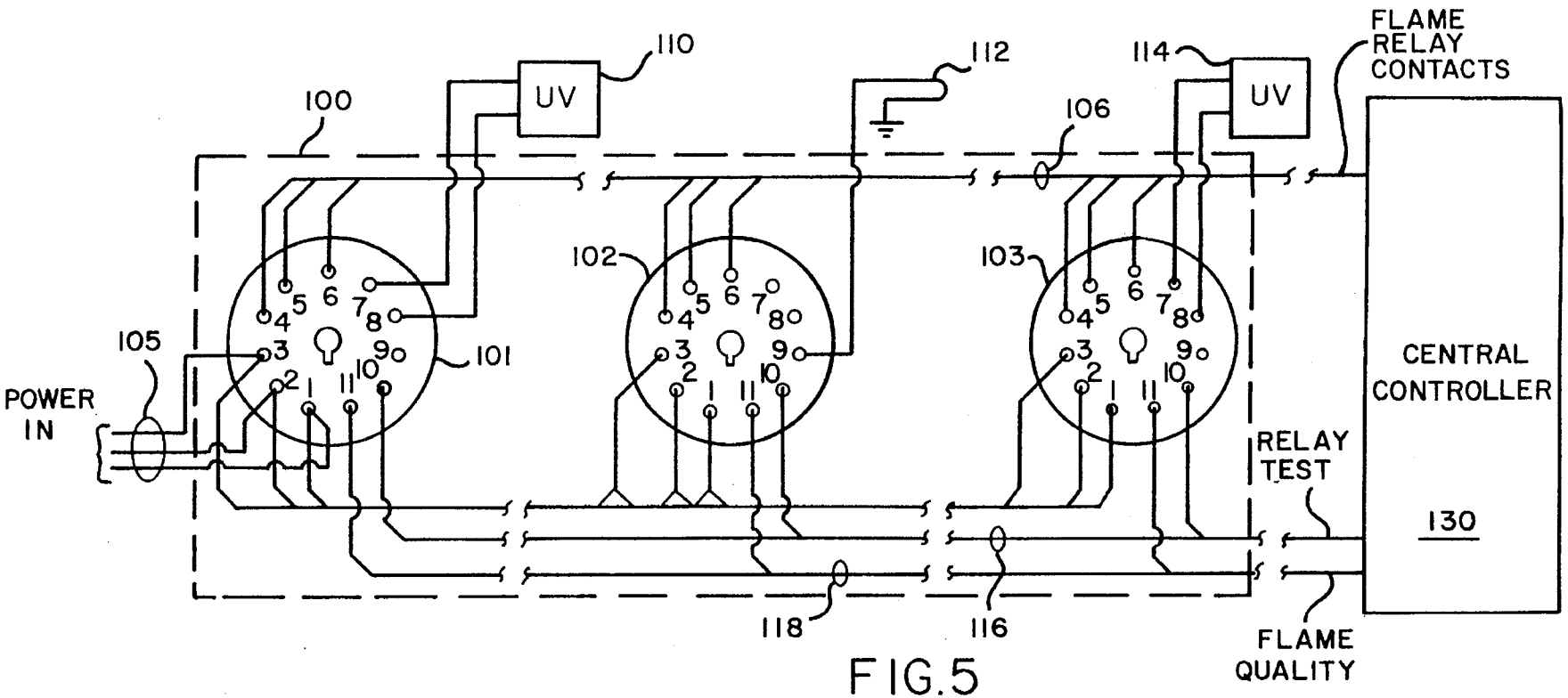
FIG. 5 is a diagram illustrating the connection of multiple modules of the type illustrated in FIG. 1 into a complex control system.

Turning to FIG. 5, the utilization of multiple units of sensors according to FIGS. 1–4 in either a standalone system or a more complex control system will be illustrated. A chassis 100 is provided having provision for a plurality of eleven pin sockets for receiving a plurality of flame sensor modules according to the invention. The chassis 100 of FIG. 5 illustrates only three flame sensor positions, but it will be appreciated that many more can and typically will be accommodated. The three sensor positions illustrated in FIG. 5 are represented by 11 pin sockets 101, 102 and 103. It will be seen that pins 1–3 are wired in parallel to a power-in bus 105, such that the same power supply can supply power to all of the relay modules in the system. A flame relay bus 106 is provided which is coupled to pins 4–6 of each plug. The wires for each set of contacts are brought out separately, and the bus 106 indicates a multi-conductor bus carrying separate signals for the switches for each of the flame sensor positions.

A further pair of buses are provided. A bus 116 is connected to pin 10 of each plug, the bus 116 being a multiple wire bus bringing out a connection for each of the pins 10 so that the relay modules can be separately tested. A similar multi-conductor bus 118 is provided for connection to pin 11 of each plug, and the analog signals brought out on the bus 118 are indicative of the flame quality sensed by each flame sensor inserted in the respective plugs 101–103.

The multiple functionality of the system is illustrated by comparing plug 101, which has an ultraviolet transducer 110 connected to pins 7 and 8, with plug 102, which has a flame rod 112 connected to pin 9 of plug 102. Plug 103 has another ultraviolet sensor 114 connected to pins 7 and 8 of plug 103. It will be seen that the wiring to the pins 7, 8 and 9 is to the receptacle which receives the module, and thus the wiring of the respective transducers 110, 112 and 114 determines the identity of the system. That determination is independent of the module which is plugged into any of the sockets. Thus, for example, the module which is installed in plug 101 may be removed if necessary and inserted in plug 102. Even though plug 102 is performing a different function—that is, controlling a flame rod rather than an ultraviolet scanner—the same flame sensor module will function for both.

The system of FIG. 5 can be run more or less standalone as thus far described, with the relay flame contacts in bus 106 being interconnected in the safety system of the respective furnaces, and the buses 116, 118 (if provided) being available for local test by a serviceman at the relay rack.

Alternatively, the system can be used with a central controller 130 illustrated in FIG. 5 as being connected to the buses 106, 116 and 118. The central controller can be any form of computerized or hard-wired controller capable of controlling a series of burners and responding to signals received from the burners via the flame sensor modules. It is preferred to utilize a system commercially available from Eclipse-Dungs known as the Series 6000 Multi-Flame Multi-Burner Controller. However, the controller forms no part of the present invention, and thus will not be further described herein.

Figure 6:
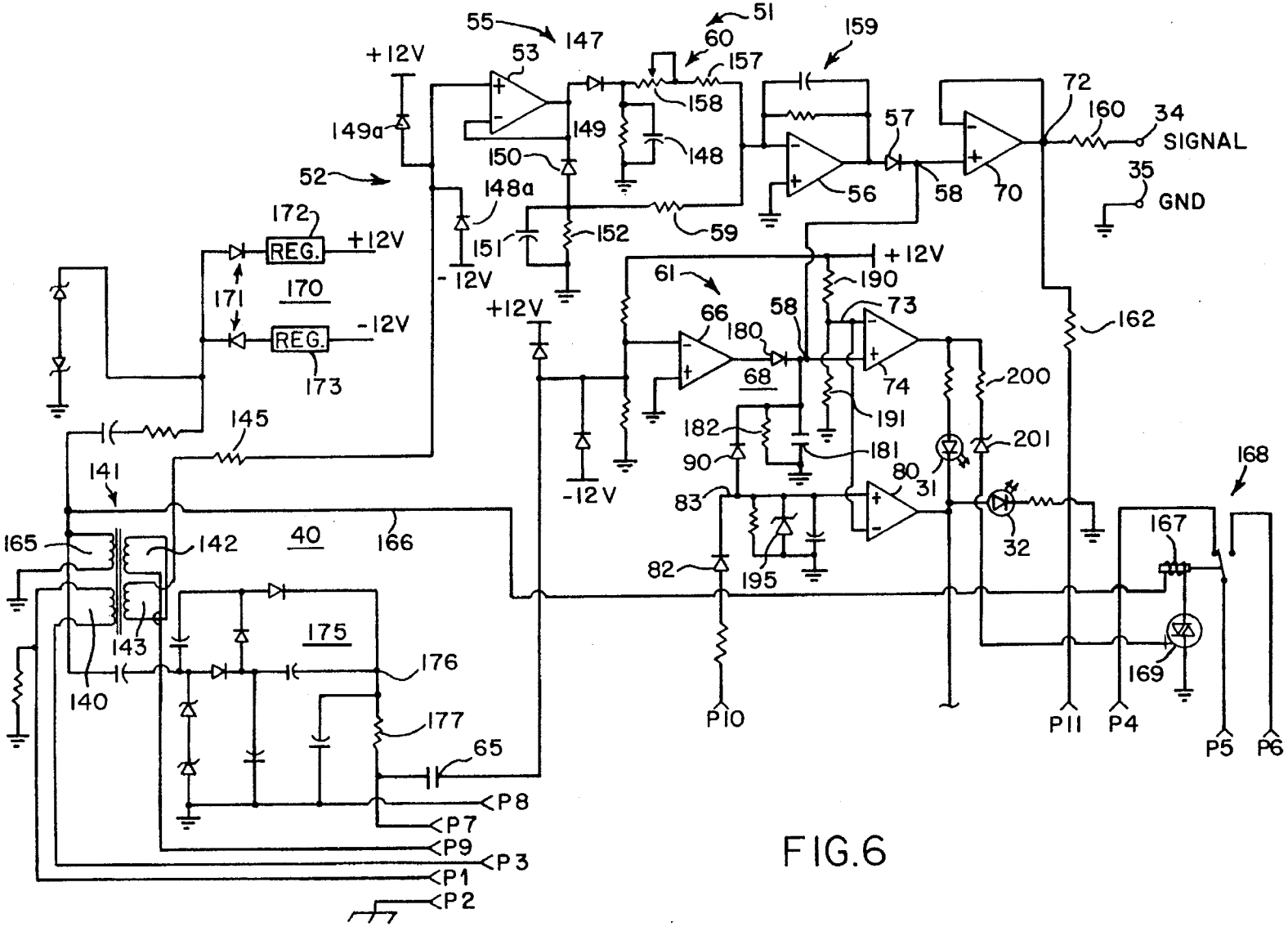
FIG. 6 is a schematic diagram showing additional details of the circuit configuration illustrated in FIG. 4.

Turning then to FIG. 6, there is shown a more detailed schematic diagram for a flame sensor module constructed in accordance with the present invention. In order to avoid complication of the drawing, the eleven pin plug 22 of FIG. 1 is not shown in the drawings as a plug, but instead the conductors which connect to the plug are indicated by a connector symbol with the designator P-X, where X is the pin number of the plug. Thus, looking at the lower left of the drawing there are shown connections P-1, P-2, and P-3 which represent connections for the incoming power. Pin 2 is connected to the chassis, i.e., to earth ground. Pins 1 and 3 are connected to a primary 140 of a multi-winding transformer generally indicated at 141. A pair of secondaries 142, 143 are connected in series, with one end of the series connection going to contact P-9, i.e., the flame rod input from the sensor. The other end of the series connected secondaries is coupled through a current limiting resistor 145 to the input of the flame rod interface circuitry 51. An amplifier 53 serves as an input and it will be seen that oppositely poled diodes 147*a*, 148*a* connected to the respective positive and negative DC power supply rails, serve the function of the clipper 52 of FIG. 4. Thus, the output of amplifier 53 is a clipped reproduction of the AC signal passed through the flame rod. It will be recalled that with no flame present there will be positive and negative peaks of substantially equal magnitude. However, when a flame is present, the positive peaks will be much smaller in magnitude than the negative peaks. The bi-polar peak follower generally indicated at 55 includes diodes and capacitors for passing and storing signals for the respective peaks. Positive peaks are passed by a diode 147 and stored in capacitor 148 associated with discharge resistor 149. Negative peaks are passed through diode 150 and stored in capacitor 151 associated with a discharge resistor 152. The respective stored signals are passed through scaling resistor 59, and calibrating control 60 to the inverting input of a summing amplifier 56. It will be seen that the calibrating control 60 is made up of a fixed element 157 and an adjustable potentiometer 158 to allow the adjustment of the voltage level corresponding to any given flame. That allows calibration of the system not only for the flame rod, but also to match the flame rod characteristics to the characteristics of the ultraviolet transducer. The amplifier 56 has a slight integrating characteristic provided by the resistor and capacitor feedback network 159, and produces a positive signal at the output thereof passed through a diode 57 to the summing junction 58. Thus, as the flame sensed by the flame rod gets larger, the disparity between the magnitudes of the positive and negative peaks will increase, causing an increasingly negative signal to be coupled to the inverting input of amplifier 56, driving its output increasingly positive. The summing amplifier 70 is connected to the junction 58, and is connected with negative feedback as a unity gain buffer amplifier, to produce at the output 72 a voltage whose magnitude varies in proportion to the quality of the pilot flame being sensed. That signal is passed through a protective resistor 160 to the test point 34 (see also FIG. 2). The signal at output 72 is also passed through a further protective resistor 162 to the analog signal pin 11 of the plug 22, identified in FIG. 5 as P-11.

Returning to the power supply, the power source 43 which drives the ultraviolet transducer will now be described. It is seen that the transformer 141 has a further secondary 165 which supplies power for the ultraviolet transducer. In addition, a line 166 connects that winding to a coil 167 of output relay 168. The relay in turn is controlled by a triac 169 having a trigger signal which will be described below. Suffice it to say for the moment that the local AC on bus 166 is supplied to the output relay for driving thereof.

The AC supply from secondary 165 is also coupled to a regulator circuit 170 which supplies the low voltage regulated DC supply for the amplifiers, comparators and other electronic elements of the circuit. It will be seen that the regulated supply 170 has a pair of input diodes 171 associated with regulators 172 and 173 so poled and arranged as to provide positive and negative DC supplies at a desirable level such as +12 and −12 volts DC.

Finally, the output of the secondary 165 is connected to the input of a voltage tripler generally indicated at 175. Without describing the tripler 175 in detail, it will be seen that capacitors are provided with appropriately poled diodes such that the capacitors are peak charged in voltage tripler fashion, to produce a relatively high level DC voltage at output 176. For example, the voltage at output 176 is preferably a DC voltage on the order of about 425 volts. That voltage is coupled through a current limiting resistor 177 to the ultraviolet connector pin 7 of the plug 22 indicated in the drawings as P-7. That pin, and therefore the ultraviolet transducer, when present, is also coupled via capacitor 65 to the inverting input of buffer amplifier 66, which serves as the input to the ultraviolet interface 61. It is seen that a diode, capacitor arrangement at the output of amplifier 66 implements the peak follower 68 which responds to positive peaks. In greater detail, a diode 180 is forward-biased whenever the peak swings more positively than the previously sensed peaks, and causes a signal to be stored on a capacitor 181. The diode 180 in the FIG. 6 embodiment also serves the function of summing diode 69 of FIG. 4 embodiment. A resistor 182 associated with a capacitor 181 discharges the capacitor at a predetermined rate. The result is that the signal on the junction 58 at the cathode of diode 180 has a DC level which is representative of the most positive excursions of the output of the amplifier 66. Since the most positive excursions of the amplifier 66 are related to the most positive excursions sensed by the ultraviolet transducer, and therefore to the quality of the flame, the voltage level at junction 58 produced by the ultraviolet transducer when present has a level which is a measure of the quality of the flame. As noted previously, the junction 58 is connected to the non-inverting input of unity gain amplifier 70 so as to produce a signal at the output 72 which is a measure of the flame quality.

The comparator 74 is shown having its non-inverting input connected to the summing junction 58. The inverting input is connected to a pair of resistors 190, 191 which serve as the reference source 73 described in connection with FIG. 4. The voltage level established at the non-inverting input is fixed at the desired reference level, for example, about 2.0 volts. Thus, whenever the output of either the amplifier 56 or the amplifier 66 causes the voltage at junction 58 to exceed 2 volts, the comparator 74 will detect that condition, and will sharply switch its output from near ground to a positive level. That signal is coupled to the anode of the green flame-on LED 31. The second comparator 80 is shown as also being connected to the resistors 190 and 191, such that the reference voltage at the inverting input is maintained at about the same reference level. The non-inverting input of the comparator 80 is coupled through a diode 82 to P-10, the test signal input for the module. Whenever the test signal input is raised to a level greater than about 12 volts, the unit will enter the test condition. The diode 82 is forward-biased and the level clamped at about 5 volts by a zener diode 195. The then-forwardly-biased diode 90 connected between the non-inverting input of comparator 80 and the non-inverting input of comparator 74 maintains a voltage difference between those two inputs, both measured against the same reference voltage. Thus, the output of the comparator 80 will be higher than the output of the comparator 74, reverse-biasing the pilot-on LED 31 and turning it off. At the same time, the flame-fail LED 32 will be forward-biased, turning that LED on to indicate the flame-fail condition.

When the test signal is removed, the voltage at the non-inverting input of comparator 80 returns to about ground level, switching the output of the comparator 80 to near ground. Assuming a flame is sensed by either the ultraviolet or flame rod sensor (whichever is installed) the positive signal at junction 58 will cause the output of comparator 74 to be high, turning on the pilot-on LED 31. At the same time, the high signal at the output of amplifier 74 will be passed through a current limiting resistor 200 and a threshold establishing zener diode 201 to the gate of the triac 169. Thus, whenever the output of amplifier 74 is brought sharply high in response to the presence of a good flame, in addition to lighting the flame-on LED 31, the triac 169 will be gated on, pulling current through the relay 167 and switching the contacts 82 from the position illustrated in FIG. 6 to the alternate state. Whenever the flame drops below the level associated with the reference voltage established by resistors 190, 191, the output of the comparator 74 will swing back to ground. The result will be the extinguishment of the pilot-on LED 31, the removal of gate bias from the triac 169, and the de-energization of relay 167 to return the contacts 82 to the condition illustrated in FIG. 6.

Thus, in normal operation, the flame relay modules can be left in a rack such as that illustrated in FIG. 5 and left substantially unattended. When a pilot flame is present whichever type of sensor is connected to the module will react, the module will produce the proper power supply, and the interface means will interpret the signal to determine whether the flame is above or below the pre-established threshold. If the flame is above the threshold, the flame-on LED will be illuminated and the relay contacts 82 will switch. Typically, the contacts are wired in the ignition circuitry or gas supply circuitry for the main burner, and the fact that the pilot is present will enable such circuitry to continue its sequence.

If a pilot is not present during start-up, there will be no switching of the relay contacts and the presence of the open contacts in the related circuitry will prevent any attempt to fire the burner. If a pilot fails during functioning of the equipment, the failure will be sensed by the appropriate detector, and the contacts will switch to signal a control system or shut down a burner, in whatever way the contacts happen to be wired. If the system is used with a controller which monitors flame failure, a signal will be coupled back to the flame sensor which had first sensed the pilot failure to illuminate the flame failure LED 32 on that module, but not on any of the others.

The system can continue to function in that way unattended. Periodically, a maintenance worker may desire to check the system. A readily available feature provided by the invention, useful for checking the quality of all pilot flames, without the necessity to disassemble or otherwise attempt to peer into the furnace, is provided by the test points 33, 34. A technician with an appropriate voltmeter, typically digital, will simply connect the probes to the test points 33, 34 and read a voltage. The voltage is calibrated by internal circuitry to be a direct indicator of the quality of the flame. The technician will know based on information for the particular equipment that a voltage reading at a particular level indicates a flame from a pilot which is functioning properly. An additional range of voltages may be present which would indicate to a technician that, while no problem is currently in existence, the pilot system should be checked and perhaps cleaned. And a voltage below a particular level, sometimes above the level necessary to cause the system to function, but below a predetermined level, may act as a trigger for the technician to undertake preventive maintenance.

With an array of modules for a multiple burner system all mounted in a single cabinet, and all having their test points readily available, a technician can rapidly move through the entire furnace line and check the voltages for each of the pilot flames, and thereby the quality of the flames. The ability to do that on a regular basis without great effort or expense or the need to disassemble the equipment is beneficial in enhancing the likely state of maintenance of the equipment and the ability of the technician to maintain it.

What is claimed is:

1. A standalone modular flame sensor adapted for use with an ultraviolet transducer, a flame rod transducer, or both said transducers, and comprising, in combination:

(a) a single plug-in modular housing containing the following elements (b)–(g), (b) a multi-function power supply having a flame rod output for driving a flame rod transducer when present and an ultraviolet output for driving an ultraviolet transducer when present;

(c) flame rod and ultraviolet interface means for connection to the flame rod transducer and ultraviolet transducer respectively when present, the interface means having a summing junction output for producing an output signal having a level dependent upon the quality of the flame sensed by the respective transducers when present;

(d) calibrating means for adjusting the output signal level so that the flame rod transducer when present and the ultraviolet transducer when present produce an output signal of about the same level for the same quality of flame;

(e) flame failure comparator means responsive to said output signal for producing a "flame-on" signal when either transducer is present and exposed to a flame, and a "flame-fail" signal when neither transducer is exposed to a flame;

(f) flame quality circuitry responsive to said output signal for producing a flame quality signal having a continuously variable level indicative of the quality of the flame sensed by either of said transducers; and (g) a test point on the housing connected to the flame quality circuitry for rendering the flame quality signal accessible at the test point for measurement.

2. The combination as set forth in claim 1 wherein the power supply also includes a low level DC supply for powering said interface means.

3. The combination as set forth in claim 1 further including relay means responsive to the flame failure comparator means for providing a contact closure output distinguishing the "flame-fail" and "flame-on" conditions.

4. The combination as set forth in claim 1 wherein the multi-function power supply includes a high voltage AC supply for coupling to the flame rod transducer and a high voltage DC supply for coupling to the ultraviolet transducer.

5. The combination as set forth in claim 1 wherein the modular housing of the flame sensor includes a multi-conductor plug formed on one surface of the housing for insertion into a socket connected to external circuitry, the housing being adapted to be gripped by the hand for removal and insertion of said modular flame sensor into an associated socket.

6. A standalone modular flame sensor adapted for use with an ultraviolet transducer, a flame rod transducer, or both said transducers, and comprising, in combination:

a multi-function power supply having a flame rod output for driving a flame rod transducer when present, and an ultraviolet output for driving an ultraviolet transducer when present;

flame rod and ultraviolet interface means for connection to the flame rod transducer and ultraviolet transducer, respectively when present, for producing an output signal having a level dependent upon the quality of the flame sensed by the associated transducers when present;

flame failure comparator means responsive to said output signal for producing a "flame-on" signal when either transducer is present and exposed to a flame, and a "flame-fail" signal when neither transducer is exposed to a flame;

flame quality circuitry responsive to said output signal for producing a flame quality signal having a continuously variable level indicative of the quality of the flame sensed by either of said transducers; and wherein the interface means includes an ultraviolet transducer interface and a flame rod transducer interface, the respective interfaces being connected at a summing junction which carries said output signal.

7. The combination as set forth in claim 6 wherein the flame rod transducer interface includes a bipolar peak follower and comparator means for comparing the magnitude of positive and negative peaks of the high voltage AC supply coupled to the flame rod transducer.

8. The combination as set forth in claim 6 in which the ultraviolet output of the multi-function power supply is a high voltage DC supply, the ultraviolet transducer when present being connected to impose fluctuations due to flame presence onto the high voltage DC supply, the ultraviolet transducer interface including AC coupling means for rendering the ultraviolet transducer interface responsive to said fluctuations, and a peak follower adapted to respond to the maximum peaks of the fluctuations.

9. The combination as set forth in claim 6 wherein the flame failure comparator means includes a comparator connected to the summing junction, the comparator having a reference signal for establishing a threshold level distinguishing the flame-on and flame-fail conditions.

10. The combination as set forth in claim 8 wherein said modular flame sensor has an external surface provided with indicator means for signalling the flame-on or flame-fail condition of the sensed flame, and test point means for providing connections to the flame quality signal for measurement thereof.

11. The combination as set forth in claim 6 wherein the flame quality circuitry comprises an amplifier connected to the summing junction for producing a flame quality signal having a voltage which varies proportionately to the quality of the flame sensed by either of said transducers.

12. The combination as set forth in claim 6 further including diodes connecting the respective ultraviolet transducer interface and flame rod transducer interface to the summing junction, the diodes being poled so that each respective transducer interface applies a signal for summation to the summing junction if the associated transducer is present and sensing a flame, and does not apply a signal for summation if the associated transducer is absent or not sensing a flame.

* * * * *